US011229924B1

(12) United States Patent
Beltran-Felix

(10) Patent No.: US 11,229,924 B1
(45) Date of Patent: Jan. 25, 2022

(54) WALL PAINTING ASSEMBLY

(71) Applicant: Sergio Beltran-Felix, Los Angeles, CA (US)

(72) Inventor: Sergio Beltran-Felix, Los Angeles, CA (US)

( * ) Notice: Subject to any disclaimer, the term of this patent is extended or adjusted under 35 U.S.C. 154(b) by 0 days.

(21) Appl. No.: 17/008,822

(22) Filed: Sep. 1, 2020

(51) Int. Cl.
*B05C 17/02* (2006.01)

(52) U.S. Cl.
CPC ..... *B05C 17/0225* (2013.01); *B05C 17/021* (2013.01); *B05C 17/023* (2013.01); *B05C 17/0205* (2013.01)

(58) Field of Classification Search
CPC ..... B05C 17/0225; B05C 17/0205; B05C 17/023
See application file for complete search history.

(56) References Cited

U.S. PATENT DOCUMENTS 3,205,526 A 9/1965 Archibald
3,623,180 A * 11/1971 Anderson ..... B05C 17/0225 15/230.11
5,623,740 A 4/1997 Burns
6,742,212 B2 6/2004 Pyles
6,925,674 B2 8/2005 Prince
7,340,796 B2 3/2008 Pyles
8,434,192 B2 5/2013 Dondurur
9,061,315 B1 6/2015 Griglak
2002/0194691 A1* 12/2002 Meyer ..... B05C 17/02 15/230.11
2006/0130254 A1* 6/2006 Futo ..... B44D 3/126 15/114
2010/0180817 A1 7/2010 Atiya

FOREIGN PATENT DOCUMENTS

WO WO2009007955 1/2009

* cited by examiner

*Primary Examiner* — Randall E Chin

(57) ABSTRACT

A wall painting assembly includes a handle unit for gripping. A shield is disposed on the handle unit for abutting against trim on a wall of a room. The handle unit is biased into a first position on the shield and the handle unit is urgeable into a second position on the shield. A roller unit is hingedly coupled to the handle unit to have paint applied thereon. The roller unit is urged downwardly when the handle unit is urged into the second position on the shield to apply the paint to the wall of the room. Additionally, the shield inhibits the paint from being applied to the trim on the wall. The roller unit is lifted upwardly when the handle unit is biased into the first position to inhibit the paint from being applied to the wall.

13 Claims, 7 Drawing Sheets

WALL PAINTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to painting devices and more particularly pertains to a new painting device for painting around trim on a wall.

(2) Description of Related Art Including Information Disclosed Under 37 CFR 1.97 and 1.98

The prior art relates to painting devices including a roller for applying paint to a planar surface. The prior art discloses a variety of painting devices that include a shield for abutting against trim on a wall and a roller for applying paint to the wall. The prior art also discloses a painting device that includes a shield that is pivotally coupled to a roller for applying paint around trim on a wall. The prior art discloses a paint roller that includes a splatter shield to inhibiting paint on the roller from splattering.

BRIEF SUMMARY OF THE INVENTION

An embodiment of the disclosure meets the needs presented above by generally comprising a handle unit for gripping. A shield is disposed on the handle unit for abutting against trim on a wall of a room. The handle unit is biased into a first position on the shield and the handle unit is urgeable into a second position on the shield. A roller unit is hingedly coupled to the handle unit to have paint applied thereon. The roller unit is urged downwardly when the handle unit is urged into the second position on the shield to apply the paint to the wall of the room. Additionally, the shield inhibits the paint from being applied to the trim on the wall. The roller unit is lifted upwardly when the handle unit is biased into the first position to inhibit the paint from being applied to the wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
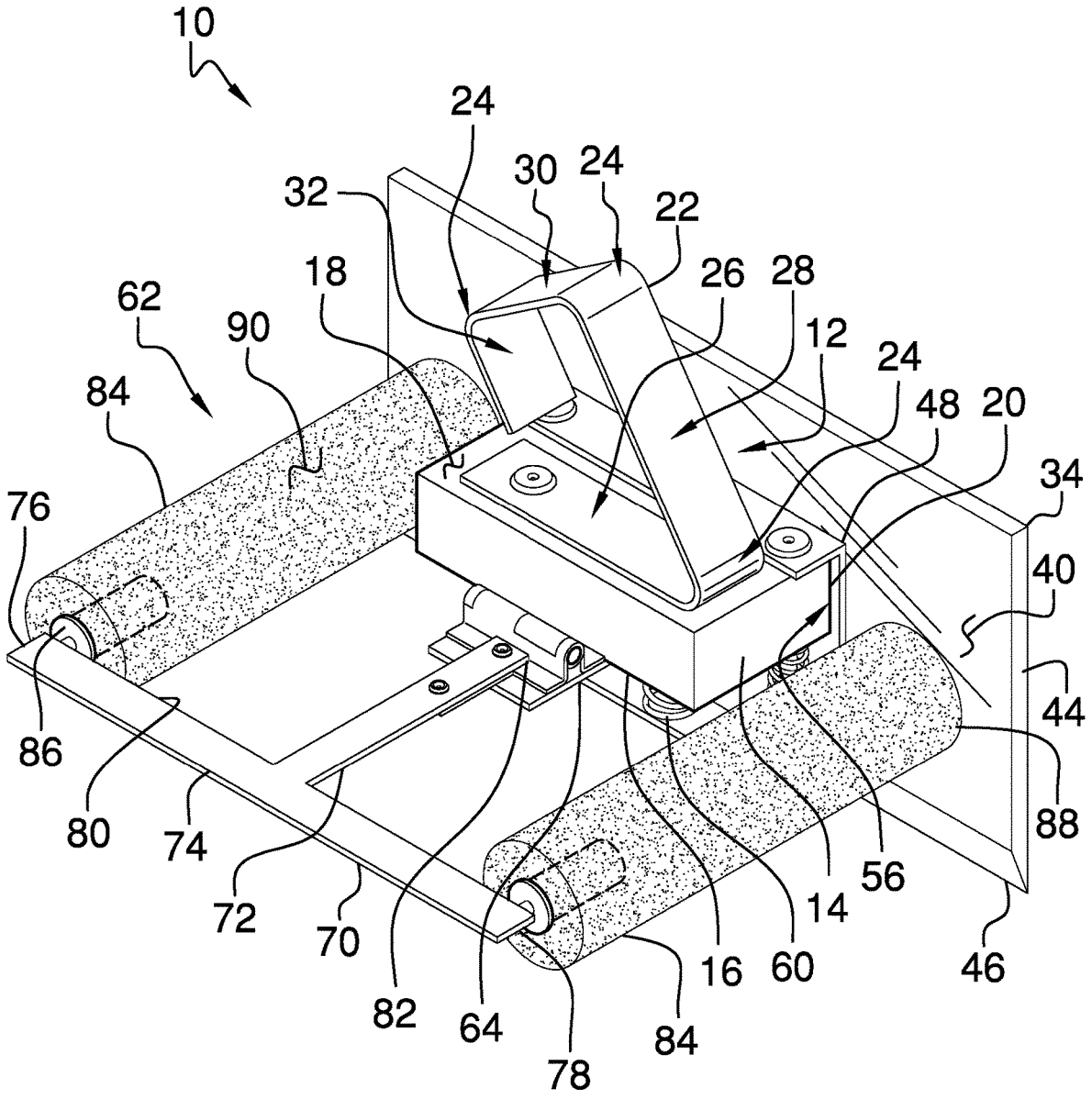
FIG. 1 is a perspective view of a wall painting assembly according to an embodiment of the disclosure.
Figure 2:
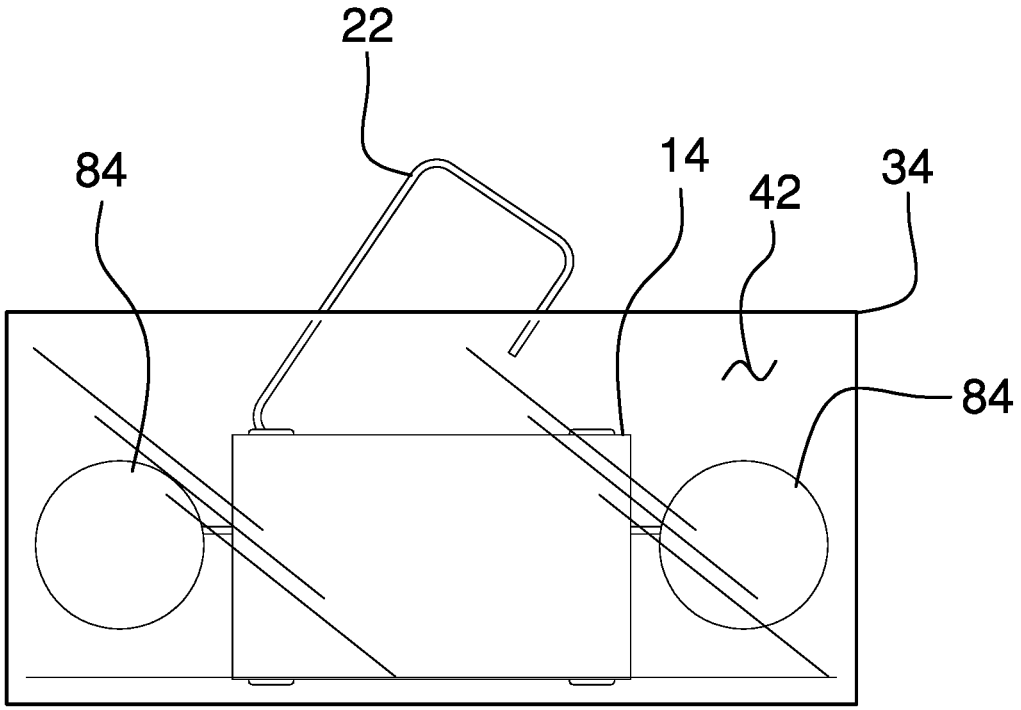
FIG. 2 is a left side view of an embodiment of the disclosure.
Figure 3:
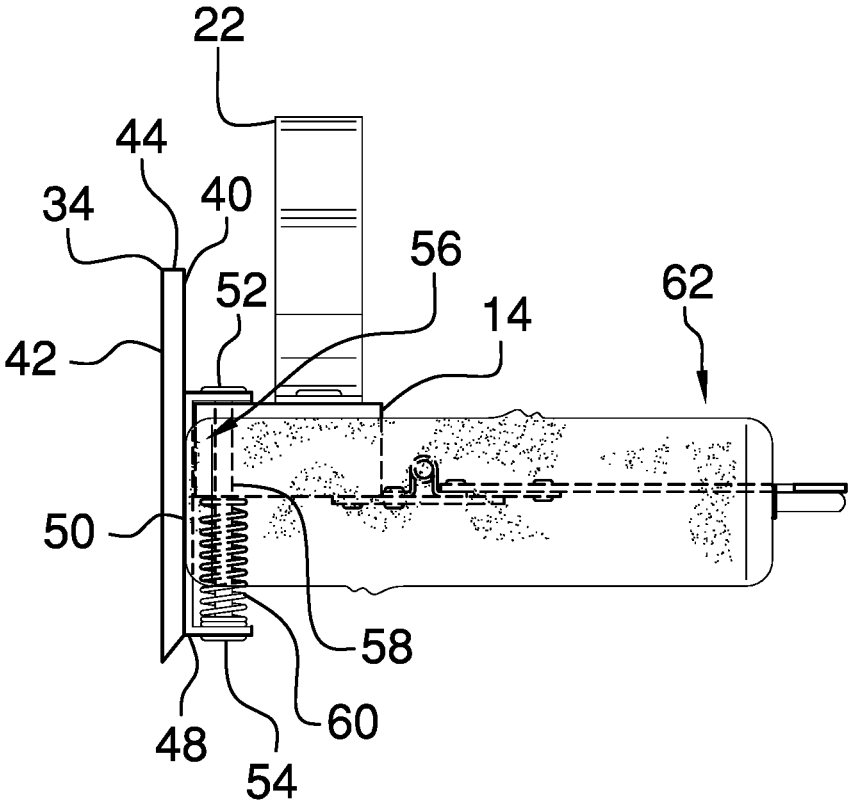
FIG. 3 is a back phantom view of an embodiment of the disclosure.
Figure 4:
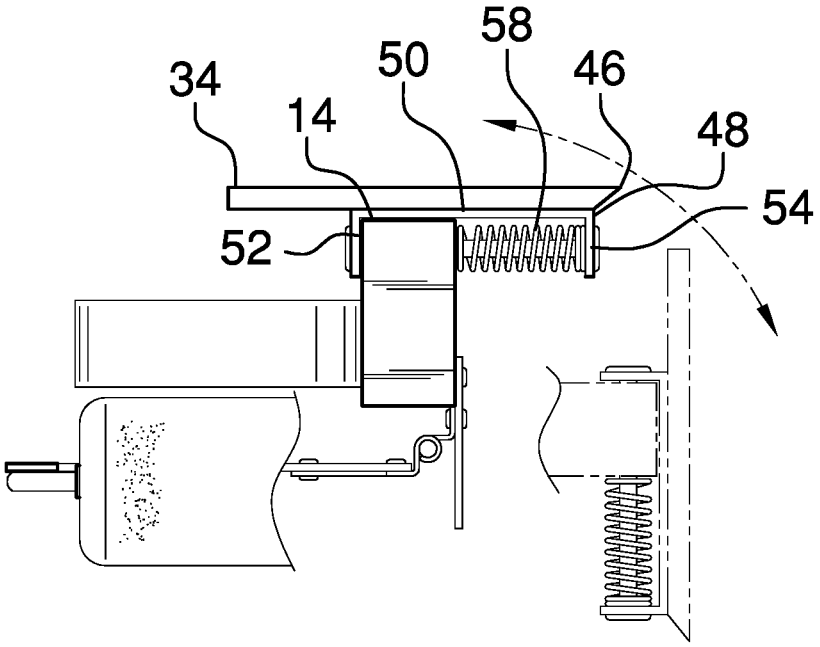
FIG. 4 is a perspective view of an embodiment of the disclosure showing a roller unit being moved between a first position and a second position.
Figure 5:
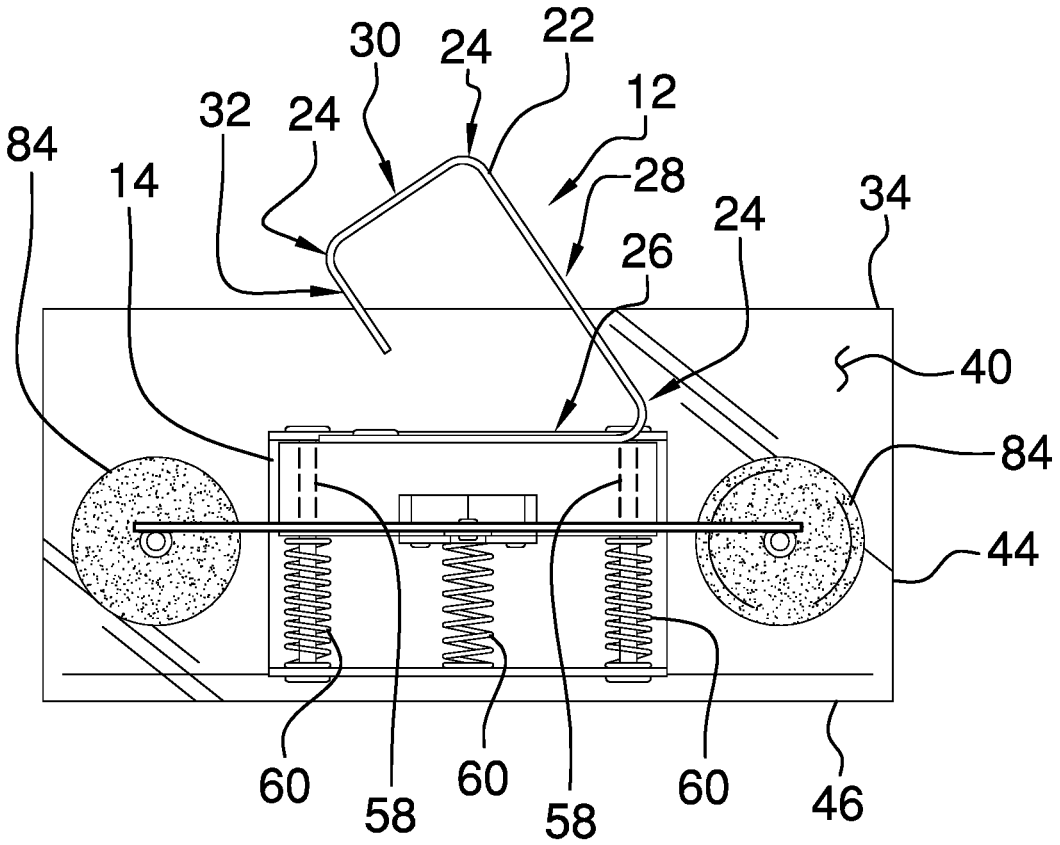
FIG. 5 is a right side view of an embodiment of the disclosure.
Figure 6:
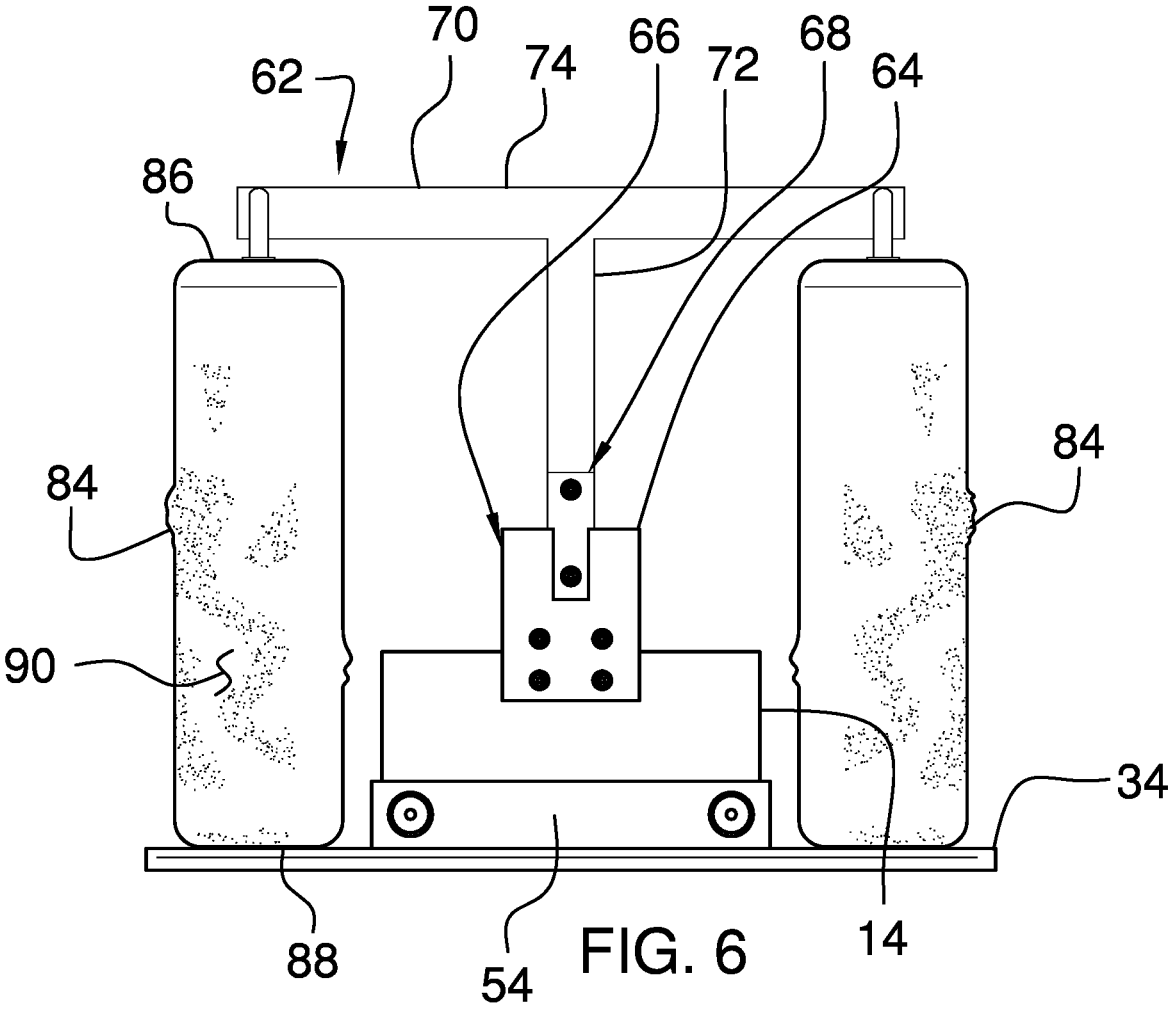
FIG. 6 is a bottom view of an embodiment of the disclosure.
Figure 7:
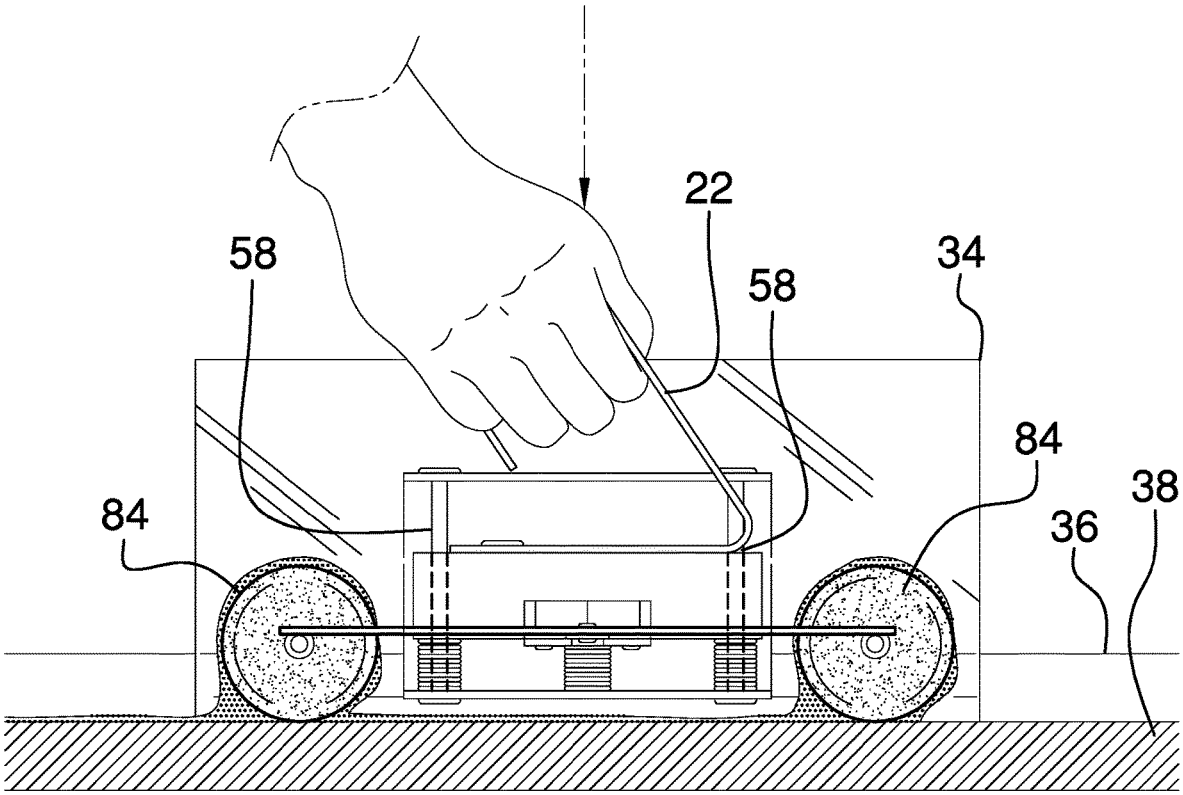
FIG. 7 is a perspective view of an embodiment of the disclosure.

With reference now to the drawings, and in particular to FIGS. 1 through 7 thereof, a new painting device embodying the principles and concepts of an embodiment of the disclosure and generally designated by the reference numeral 10 will be described.

As best illustrated in FIGS. 1 through 7, the wall painting assembly 10 generally comprises a handle unit 12 for gripping. The handle unit 12 comprises a block 14 that has a bottom surface 16, a top surface 18 and a front surface 20. The handle unit 12 includes a handle 22 that is longitudinally elongated. The handle 22 has a plurality of bends 24 thereon to define a first section 26 forming an angle with a second section 28, a third section 30 forming an angle with the second section 28 and a fourth section 32 forming an angle with the third section 30. The first section 26 is coupled to the top surface 18 of the block 14 and the second section 28 angles upwardly from the top surface 18. Additionally, the third section 30 is spaced upwardly from the top surface 18 and the fourth section 32 angles downwardly toward the first section 26. Thus, the third section 30 can be gripped by a user and the fourth section 32 inhibits the user's hand from slipping off of the third section 30.

A shield 34 is provided and the shield 34 is disposed on the handle unit 12. In this way the shield 34 can be abutted against trim 36 on a wall 38 of a room. The handle unit 12 is movable on the shield 34 and the handle unit 12 is biased into a first position on the shield 34. Additionally, the handle unit 12 is urgeable into a second position on the shield 34. The shield 34 has a first surface 40, a second surface 42 and a perimeter edge 44 extending therebetween. The perimeter edge 44 has a bottom side 46 that abuts the wall 38 on which the trim 36 is mounted having the second surface 42 abutting the trim 36. Additionally, the bottom side 46 tapers to a point.

A block bracket 48 is provided that has a central portion 50 extending between a top portion 52 and a bottom portion 54. The central portion 50 is coupled to the first surface 40 of the shield 34 having each of the top portion 52 and the bottom portion 54 extending laterally away from the first surface 40. Moreover, a block space 56 is defined between the top portion 52 and the bottom portion 54. The block 14 is positioned in the block space 56 having the top surface 18 of the block 14 facing the top portion 52 and having the bottom surface 16 of the block 14 facing the bottom portion 54.

A plurality of rods 58 is each coupled between the bottom portion 54 of the block bracket 48 and the block 14 for retaining the block 14 in the block space 56. Additionally, the block 14 is slidable upwardly and downwardly on the rods 58. A plurality of biasing members 60 is each positioned around a respective one of the rods 58. Each of the biasing members 60 extends between the bottom portion 54 of the block bracket 48 and the bottom surface 16 of the block 14. Additionally, each of the biasing members 60 biases the block 14 upwardly on the rods 58 and each of the biasing members 60 is compressed when the block 14 is slid downwardly along the rods 58.

A roller unit 62 is hingedly coupled to the handle unit 12 and paint can be applied to the roller unit 62. The paint may be a latex interior paint or any other type of liquid treatment that is commonly applied to walls and floors of a building. The roller unit 62 is positionable in a first position having the roller unit 62 being oriented perpendicular to the shield 34. Additionally, the roller unit 62 is positionable in a second position having the roller unit 62 being oriented parallel to the shield 34. The roller unit 62 is urged downwardly when the handle unit 12 is urged into the second position on the shield 34 to apply the paint to the wall 38 of the room. Conversely, the roller unit 62 is lifted upwardly when the handle unit 12 is biased into the first position to inhibit the paint from being applied to the wall 38.

The roller unit 62 comprises a hinge 64 that has a first half 66 pivotally coupled to a second half 68. The first half 66 is coupled to the bottom surface 16 of the block 14 having the second half 68 being exposed with respect to the block 14. A roller bracket 70 is provided that has a first member 72 being oriented perpendicular to a second member 74. The second member 74 has a first end 76, a second end 78 and a first edge 80 extending therebetween. The first member 72 is centrally positioned between the first end 76 and the second end 78 and the first member 72 has a distal end 82 with respect to the second member 74. Moreover, the distal end 82 is coupled to the second half 68 of the hinge 64. The first member 72 extends along a line being oriented parallel to the first surface 40 of the shield 34 when the roller unit 62 is positioned in the second position. The first member 72 extends along a line being oriented perpendicular to the first surface 40 of the shield 34 when the roller unit 62 is positioned in the first position.

The roller unit 62 includes a pair of rollers 84 that each has a primary end 86, a secondary end 88 and an outside surface 90 extending therebetween. The primary end 86 of each of the rollers 84 is rotatably coupled to the first edge 80 of the second member 74. Each of the rollers 84 is positioned adjacent to a respective one of the first end 76 and the second end 78 of the second member 74. Additionally, each of the rollers 84 extends along an axis that is oriented parallel to the first member 72. Each of rollers 84 is removable from the second member 74 for cleaning the rollers 84 and each of the rollers 84 is comprised of a fluid absorbent material for absorbing the paint. The outside surface 90 of each of the rollers 84 abuts the wall 38 when the handle unit 12 is urged into the second position to apply the paint to the wall 38. Conversely, the outside surface 90 of each of the rollers 84 is spaced from the wall 38 when the handle unit 12 is biased into the first position to inhibit the wall 38 from being painted.

In use, the roller unit 62 is positioned in the second position to facilitate each of the rollers 84 to be dipped into a paint tray for applying paint to the rollers 84. The roller unit 62 is positioned in the first position and the shield 34 is positioned against the trim 36 on the wall 38 to be painted. Pressure is applied to the handle unit 12 to urge the handle unit 12 into the second position for pressing the rollers 84 against the wall 38. The handle unit 12 is pushed along the wall 38 to apply the paint to the wall 38 and the shield 34 inhibits the paint from being applied to the trim 36. The pressure is released on the handle unit 12 to facilitate the handle unit 12 to be biased into the first position for lifting the rollers 84 from the wall 38 when the process of painting the wall 38 is complete. In this way the wall 38 can be painted around door trim, for example, in a quick and efficient manner without getting paint on the door trim.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wall painting assembly for painting a wall adjacent to trim while keeping the trim from being painted, said assembly comprising:

a handle unit for gripping;

a shield being disposed on said handle unit wherein said shield is configured to be abutted against trim on a wall of a room, said handle unit movable on said shield, said handle unit being biased into a first position on said shield, said handle unit being urgeable into a second position on said shield; and a roller unit being hingedly coupled to said handle unit wherein said roller unit is configured to have paint applied thereon, said roller unit being positionable in a first position having said roller unit being oriented perpendicular to said shield, said roller unit being positionable in a second position having said roller unit being oriented parallel to said shield, said roller unit being urged downwardly when said handle unit is urged into said second position on said shield wherein said roller unit is configured to apply the paint to the wall of the room, said roller unit being lifted upwardly when said handle unit is biased into said first position wherein said roller unit is configured to inhibit the paint from being applied to the wall.

2. The assembly according to claim 1, wherein said handle unit comprises:

a block having a bottom surface, a top surface and a front surface; and a handle being longitudinally elongated, said handle having a plurality of bends thereon to define a first section forming an angle with a second section, a third section forming an angle with said second section and a fourth section forming an angle with said third section, said first section being coupled to said top surface of said block having said second section angling upwardly from said top surface, said third section being spaced upwardly from said top surface having said fourth section angling downwardly toward said first section wherein said third section is configured to be gripped by a user having said fourth section inhibiting the user's hand from slipping off of said third section.

3. The assembly according to claim 2, wherein said shield has a first surface, a second surface and a perimeter edge extending therebetween, said perimeter edge having a bottom side wherein said bottom side is configured to abut the wall on which the trim is mounted having said second surface abutting the trim, said bottom side tapering to a point.

4. The assembly according to claim 3, further comprising a block bracket having a central portion extending between a top portion and a bottom portion, said central portion being coupled to said first surface of said shield having each of said top portion and said bottom portion extending laterally away from said first surface to define a block space between said top portion and said bottom portion, said block being positioned in said block space having said top surface of said block facing said top portion and having said bottom surface of said block facing said bottom portion.

5. The assembly according to claim 4, further comprising a plurality of rods, each of said rods being coupled between said bottom portion of said block bracket and said block for retaining said block in said block space, said block being slidable upwardly and downwardly on said rods.

6. The assembly according to claim 5, further comprising a plurality of biasing members, each of said biasing members being positioned around a respective one of said rods, each of said biasing members extending between said bottom portion of said block bracket and said bottom surface of said block, each of said biasing members biasing said block upwardly on said rods, each of said biasing members being compressed when said block is slid downwardly along said rods.

7. The assembly according to claim 2, wherein said roller unit comprises a hinge having a first half being pivotally coupled to a second half, said first half being coupled to said bottom surface of said block having said second half being exposed with respect to said block.

8. The assembly according to claim 7, wherein said roller unit includes a roller bracket having a first member being oriented perpendicular to a second member, said second member having a first end, a second end and a first edge extending therebetween, said first member being centrally positioned between said first end and said second end, said first member having a distal end with respect to said second member, said distal end being coupled to said second half of said hinge.

9. The assembly according to claim 8, wherein said first member extends along a line being oriented parallel to a first surface of said shield when said roller unit is positioned in said second position, said first member extending along a line being oriented perpendicular to said first surface of said shield when said roller unit is positioned in said first position.

10. The assembly according to claim 9, wherein said roller unit includes a pair of rollers, each of said rollers having a primary end, a secondary end and an outside surface extending therebetween, said primary end of each of said rollers being rotatably coupled to said first edge of said second member, each of said rollers being positioned adjacent to a respective one of said first end and said second end of said second member, each of said rollers extending along an axis being oriented parallel to said first member, each of rollers being removable from said second member for cleaning said rollers.

11. The assembly according to claim 10, wherein each of said rollers is comprised of a fluid absorbent material wherein each of said rollers is configured to have the paint applied thereto.

12. The assembly according to claim 10, wherein said outside surface of each of said rollers abuts the wall when said handle unit is urged into said second position wherein said rollers are configured to apply the paint to the wall, said outside surface of each of said rollers being spaced from the wall when said handle unit is biased into said first position wherein said rollers are configured to inhibit the wall from being painted.

13. A wall painting assembly for painting a wall adjacent to trim while keeping the trim from being painted, said assembly comprising:

a handle unit for gripping, said handle unit comprising:

a block having a bottom surface, a top surface and a front surface; and a handle being longitudinally elongated, said handle having a plurality of bends thereon to define a first section forming an angle with a second section, a third section forming an angle with said second section and a fourth section forming an angle with said third section, said first section being coupled to said top surface of said block having said second section angling upwardly from said top surface, said third section being spaced upwardly from said top surface having said fourth section angling downwardly toward said first section wherein said third section is configured to be gripped by a user having said fourth section inhibiting the user's hand from slipping off of said third section;

a shield being disposed on said handle unit wherein said shield is configured to be abutted against trim on a wall of a room, said handle unit being movable on said shield, said handle unit being biased into a first position on said shield, said handle unit being urgeable into a second position on said shield, said shield having a first surface, a second surface and a perimeter edge extending therebetween, said perimeter edge having a bottom side wherein said bottom side is configured to abut the wall on which the trim is mounted having said second surface abutting the trim, said bottom side tapering to a point;

a block bracket having a central portion extending between a top portion and a bottom portion, said central portion being coupled to said first surface of said shield having each of said top portion and said bottom portion extending laterally away from said first surface to define a block space between said top portion and said bottom portion, said block being positioned in said block space having said top surface of said block facing said top portion and having said bottom surface of said block facing said bottom portion;

a plurality of rods, each of said rods being coupled between said bottom portion of said block bracket and said bottom surface of said block for retaining said block in said block space, said block being slidable upwardly and downwardly on said rods;

a plurality of biasing members, each of said biasing members being positioned around a respective one of said rods, each of said biasing members extending between said bottom portion of said block bracket and said bottom surface of said block, each of said biasing members biasing said block upwardly on said rods, each of said biasing members being compressed when said block is slid downwardly along said rods; and a roller unit being hingedly coupled to said handle unit wherein said roller unit is configured to have paint applied thereon, said roller unit being positionable in a first position having said roller unit being oriented perpendicular to said shield, said roller unit being positionable in a second position having said roller unit being oriented parallel to said shield, said roller unit being urged downwardly when said handle unit is urged into said second position on said shield wherein said roller unit is configured to apply the paint to the wall of the room, said roller unit being lifted upwardly when said handle unit is biased into said first position wherein said roller unit is configured to inhibit the paint from being applied to the wall, said roller unit comprising:

a hinge having a first half being pivotally coupled to a second half, said first half being coupled to said bottom surface of said block having said second half being exposed with respect to said block;

a roller bracket having a first member being oriented perpendicular to a second member, said second member having a first end, a second end and a first edge extending therebetween, said first member being centrally positioned between said first end and said second end, said first member having a distal end with respect to said second member, said distal end being coupled to said second half of said hinge, said first member extending along a line being oriented parallel to said first surface of said shield when said roller unit is positioned in said second position, said first member extending along a line being oriented perpendicular to said first surface of said shield when said roller unit is positioned in said first position; and a pair of rollers, each of said rollers having a primary end, a secondary end and an outside surface extending therebetween, said primary end of each of said rollers being rotatably coupled to said first edge of said second member, each of said rollers being positioned adjacent to a respective one of said first end and said second end of said second member, each of said rollers extending along an axis being oriented parallel to said first member, each of rollers being removable from said second member for cleaning said rollers, each of said rollers being comprised of a fluid absorbent material wherein each of said rollers is configured to have the paint applied thereto, said outside surface of each of said rollers abutting the wall when said handle unit is urged into said second position wherein said rollers are configured to apply the paint to the wall, said outside surface of each of said rollers being spaced from the wall when said handle unit is biased into said first position wherein said rollers are configured to inhibit the wall from being painted.

* * * * *